US006701566B2

(12) United States Patent
Rooke

(10) Patent No.: US 6,701,566 B2
(45) Date of Patent: Mar. 9, 2004

(54) TRAILER ELECTRICAL CONNECTOR CLEANING SYSTEM

(76) Inventor: Craig T. Rooke, 9868 Picacho Ct., Sun City, AZ (US) 85373

( * ) Notice: Subject to any disclaimer, the term of this patent is extended or adjusted under 35 U.S.C. 154(b) by 53 days.

(21) Appl. No.: 09/916,061

(22) Filed: Jul. 26, 2001

(65) Prior Publication Data

US 2003/0019059 A1 Jan. 30, 2003

(51) Int. Cl.[7] ..... B08B 9/02; A46B 7/00

(52) U.S. Cl. ..... 15/104.04; 15/104.05; 15/111; 15/184

(58) Field of Search ..... 15/104.001, 104.04, 15/104.05, 105, 106, 111, 184

(56) References Cited

U.S. PATENT DOCUMENTS

| | | | | |
|---|---|---|---|---|
| 606,184 | A | | 6/1898 | Burnip |
| 1,461,904 | A | | 7/1923 | Hoyem |
| 1,710,127 | A | | 4/1929 | Vaughn |
| 1,950,862 | A | | 3/1934 | Page |
| 3,088,150 | A | | 5/1963 | Sweeney |
| 3,946,456 | A | | 3/1976 | Martin et al. |
| 4,133,070 | A | * | 1/1979 | Litt |
| 4,204,294 | A | | 5/1980 | Halverson |
| 4,575,892 | A | | 3/1986 | Ross |
| 4,899,409 | A | | 2/1990 | Cox, Jr. |
| 5,070,568 | A | * | 12/1991 | Wilcox |
| 5,094,556 | A | * | 3/1992 | Kohler |
| 5,269,104 | A | * | 12/1993 | DiBiagio |
| 5,307,534 | A | * | 5/1994 | Miller |
| 5,513,411 | A | | 5/1996 | Simon |
| 5,622,195 | A | * | 4/1997 | Lee |
| 5,791,005 | A | * | 8/1998 | Grabowski |
| 6,220,950 | B1 | * | 4/2001 | Novitsky |
| 6,286,171 | B1 | * | 9/2001 | Sztymelski |

FOREIGN PATENT DOCUMENTS

| | | | |
|---|---|---|---|
| CH | 267259 | * | 3/1950 |

* cited by examiner

*Primary Examiner*—Randall E. Chin
(74) *Attorney, Agent, or Firm*—Martin L. Stoneman

(57) ABSTRACT

A system for the cleaning of male and female terminals comprised within electrical connectors. The system is a small, compact, portable system that comprises at least one cleaning element wherein the cleaning element may be a brush cleaning element, or alternatively may be a helical cleaning element, and wherein the cleaning element may be used for the cleaning of female electrical terminals. Further, the system may comprise an additional helical cleaning element that may be used for the cleaning of male electrical terminals. The system further comprises enclosing structure that isolates the cleaning element, or elements, from the environment to prevent the dropping of debris from the cleaning elements into the pocket of a user carrying the cleaning system. The system further comprises a pocket clip for the carrying of the system.

33 Claims, 4 Drawing Sheets

TRAILER ELECTRICAL CONNECTOR CLEANING SYSTEM

BACKGROUND OF THE INVENTION

1. Field of the Invention

This invention relates to providing electrical terminal-cleaning systems. More particularly, this invention provides a system for the cleaning of male and female terminals comprised within trailer electrical connectors.

2. Description of the Prior Art

Trailer electrical connectors carry the power to illuminate the trailer lights, charge auxiliary batteries, activate braking systems, etc. Such trailer electrical connectors generally comprise substantially round body connectors having a plurality of individual electrical terminals therein. Such electrical connectors comprise male and female electrical terminals that are preferably designed to mate with one another, thus, forming a low resistance path for electrical current flow. However, due to the exposure of such trailer electrical connectors to the elements, the male and female electrical terminals often become covered in dirt or corrosion that will prevent a satisfactory electrical contact between the male and female electrical terminals. Therefore, it is a common sight to see owners and operators of trailers scrapping at the male and female electrical terminals with a pocket knife, or some other make-shift tool, in an attempt to remove dirt or corrosion in order to reestablish satisfactory electrical contact.

In the prior art, devices for the cleaning of trailer electrical connectors are available, but such systems have drawbacks. For example, the "Device For Cleaning Electrical Systems", U.S. Pat. No. 4,575,892, by Ross, shows a terminal-cleaning device. However, the Ross terminal-cleaning device features a plurality of brushes all permanently and integrally arranged upon the terminal-cleaning device, i.e., a first set of brushes is designed to clean a specific number and configuration of female terminals integral to a female trailer electrical connector. The specific arrangement of the first set of brushes comprises seven brushes specifically arranged to be inserted into a female trailer connector having seven female terminals in the same specific arrangement as the first set of brushes upon the terminal-cleaning device. Consequently, when the first set of brushes is inserted into a female trailer connector having seven female terminals, only linear movement parallel to the longitudinal axis of the female terminals is possible. Thus, this prior art terminal-cleaning device cannot be used to clean other trailer electrical connectors having a different female terminal configuration. Additionally, the plural arrangement of brushes only allows for axial linear movement, rather than both axial linear and axial rotational cleaning motion. Thus, it is possible that a complete cleaning of a female terminal will not occur.

The terminal-cleaning device further features a second set of brushes having an arrangement and configuration of a plurality of brushes configured to surround the male terminals of the analogous configuration as the seven female terminals. Again, such an arrangement is only suitable for linear axial movement, and only then to clean a male trailer electrical connector having seven male terminals in the same specific arrangement as the second set of brushes.

An additional problem with this terminal-cleaning device is that if any electrical power is present on any of the male or female terminals, the brushes and/or terminal-cleaning device could cause a short circuit within the electrical system of the trailer or the towing vehicle.

Further known prior art is the "Electrical Terminal-cleaning Device", U.S. Pat. No. 4,204,294, by Halverson. The Halverson device features a plurality of various sized brushes for the cleaning of female electrical terminal connectors. The various sized brushes are all hingably coupled to a folding case, allowing a single brush to be accessed for the cleaning of an applicable sized female terminal upon a trailer electrical connector. However, this electrical terminal-cleaning device only features a single rigid cylinder for the cleaning of male terminals. Such a rigid cylinder having no resilience to it is constrained in the cleaning action that can be brought to bear upon a male electrical terminal and is also only potentially suited for a single-sized male electrical terminal.

An additional drawback of both of the prior art terminal-cleaning devices is that neither comprises a sealed unit. Thus, debris, such as dirt, scale, oil, road-tar, etc., clinging to the brushes or rigid cylinder, may drop from the cleaning device while being carried in a pocket and cause soiling of the user's clothes. Further yet, an additional drawback of both of the prior art terminal-cleaning devices is that neither device comprises a very small compact device adapted to be easily carried in a shirt pocket.

Therefore, a need exists for a trailer electrical connector cleaning system that is usable with different trailer electrical connectors having different arrangements and configurations of electrical terminals. Another need exists for a trailer electrical connector cleaning system that allows both linear axial and rotational axial cleaning movements. A further need exists for a trailer electrical connector cleaning system that will not cause short-circuiting between the electrical terminals of a trailer connector plug or jack. Yet another need exists for a trailer electrical connector cleaning system that provides a resilient male electrical terminal-cleaning element. Yet a further need exists for a trailer electrical connector cleaning system that features a closed or sealed carrying position that will not drop debris clinging to the cleaning elements into the pockets of the user's clothing. Additionally, another need exists for a trailer electrical connector cleaning system that is very small, compact, and adapted to be easily carried in a shirt pocket.

OBJECTS OF THE INVENTION

A primary object and feature of the present invention is to fulfill the above-mentioned needs by providing a trailer electrical connector cleaning system that is usable with different trailer electrical connectors having different arrangements and configurations of electrical terminals. Another primary object and feature of the present invention is to provide such a trailer electrical connector cleaning system that allows both linear axial and rotational axial cleaning movements. A further primary object and feature of the present invention is to provide such a trailer electrical connector cleaning system that will not cause short-circuiting between the electrical terminals of a trailer connector plug or jack. Yet another primary object and feature of the present invention is to provide such a trailer electrical connector cleaning system that provides a resilient electrical terminal-cleaning element. Yet a further primary object and feature of the present invention is to provide such a trailer electrical connector cleaning system that features a closed or sealed carrying position to prevent debris clinging to the cleaning elements from dropping into the pockets of the user's clothing. Additionally, another primary object and feature of the present invention is to provide such a trailer electrical connector cleaning system that is very small, compact, and adapted to be easily carried in a shirt pocket.

Other objects and features of this invention will become apparent with reference to the following invention descriptions.

SUMMARY OF THE INVENTION

In accordance with a preferred embodiment of the present invention, this invention provides a trailer-electrical-connector cleaning system comprising: at least one cleaning structure arranged to enable an axial linear and axial rotational cleaning motion to be applied to a trailer-electrical-connector electrical terminal; and at least one enclosing structure arranged to enable enclosing such at least one cleaning structure in such manner as to substantially isolate such at least one cleaning structure from an environment outside such at least one enclosing structure. This invention further provides such a system comprising at least one second cleaning structure, having an opposite mating structure than such cleaning structure, arranged to enable an axial linear and axial rotational cleaning motion to be applied to a second electrical terminal. It also provides such a system wherein such at least one second cleaning structure comprises a brush cleaning element structured and arranged to enable cleaning of female electrical terminals. Plus it provides such a system wherein such brush cleaning element comprises bristle material comprised of steel. In addition it provides such a system wherein such steel comprises stainless steel. Furthermore, this invention provides such a system further comprising a pocket clip, coupled to such at least one enclosing structure, arranged to couple such at least one enclosing structure to a pocket. Still further it provides such a system wherein such at least one cleaning structure comprises a helical cleaning element structured and arranged to enable cleaning of male electrical terminals, and it also provides such a system wherein such helical cleaning element comprises steel. Additionally, it provides such a system wherein such steel comprises stainless steel. This invention also provides such a system wherein such helical cleaning element comprises an abrasive surface. And it further provides such a system wherein such at least one cleaning structure comprises a helical cleaning element structured and arranged to enable cleaning of female electrical terminals. It also provides such a system wherein such helical cleaning element comprises steel, and it further provides such a system wherein such steel comprises stainless steel, and even further wherein such helical cleaning element comprises an abrasive surface. This invention also provides such a system wherein: such at least one enclosing structure comprises a single substantially-tubular member; and frictional coupling of such at least one cleaning structure and such at least one second cleaning structure to such single substantially-tubular member enables enclosing such at least one cleaning structure and such at least one second cleaning structure in such manner as to substantially isolate such cleaning structures from an environment outside such at least one enclosing structure. Additionally, this invention provides such a system wherein: such at least one enclosing structure comprises two substantially-tubular members; and frictional coupling of such at least one cleaning structure and such at least one second cleaning structure to such two substantially-tubular members enables enclosing such at least one cleaning structure and such at least one second cleaning structure in such manner as to substantially isolate such cleaning structures from an environment outside such at least one enclosing structure.

In addition, this invention provides, in accordance with a preferred embodiment thereof, an electrical connector cleaning system for cleaning electrical terminals of hard-metal, low-amperage vehicle electrical connectors. Such an invention comprises: at least one cleaning structure arranged to enable an axial linear and axial rotational cleaning motion to be applied to an electrical terminal; and at least one second cleaning structure, having an opposite mating structure than such at least one cleaning structure, arranged to enable an axial linear and axial rotational cleaning motion to be applied to a second electrical terminal. Such an invention further provides such a system wherein such at least one second cleaning structure comprises a brush cleaning element structured and arranged to enable cleaning of female electrical terminals. Also, it provides such a system wherein such brush cleaning element comprises bristle material comprised of steel, and even further wherein such steel comprises stainless steel. Additionally, this invention provides such a system wherein such at least one cleaning structure comprises a helical cleaning element structured and arranged to enable cleaning of male electrical terminals. This invention also provides such a system wherein such helical cleaning element comprises steel, and further it provides such a system wherein such steel comprises stainless steel. It also provides such a system wherein such helical cleaning element comprises an abrasive surface. The invention also provides such a system wherein such at least one cleaning structure comprises a helical cleaning element structured and arranged to enable cleaning of female electrical terminals. Also, it provides such a system wherein such helical cleaning element comprises steel, and it also provides such a system wherein such steel comprises stainless steel. This invention also provides such a system wherein such helical cleaning element comprises an abrasive surface.

Additionally still, this invention provides, in accordance with another preferred embodiment thereof, an electrical connector cleaning system for non-lead, low-amperage, electrical terminals comprising: at least one cleaning structure arranged to enable an axial linear and axial rotational cleaning motion to be applied to the electrical terminals; and wherein such at least one cleaning structure comprises a helical cleaning element structured and arranged to clean the electrical terminals. It also provides such a system wherein such helical cleaning element comprises steel, and even further it provides such a system wherein such steel comprises stainless steel. Moreover, it provides such a system wherein such steel comprises an abrasive surface. The invention also provides such a system comprising at least one enclosing structure, wherein: such at least one enclosing structure comprises a single substantially-tubular member; and frictional coupling of such at least one cleaning structure to such single substantially-tubular member enables enclosing such at least one cleaning structure in such manner as to substantially isolate such cleaning structure from an environment outside such at least one enclosing structure. It further provides such an invention further comprising a pocket clip coupled to such at least one enclosing structure arranged to couple such at least one enclosing structure to a pocket. And it also provides such a system wherein such helical cleaning element comprises a sharp edge upon inner circumferential edges of such helical cleaning element structured and arranged to assist cleaning of electrical terminals of male design. And, it also provides such a system wherein such helical cleaning element comprises a sharp edge upon outer circumferential edges of such helical cleaning element structured and arranged to assist cleaning of electrical terminals of female design.

DETAILED DESCRIPTION OF A PREFERRED EMBODIMENT AND THE BEST MODE OF PRACTICE

Figure 1:
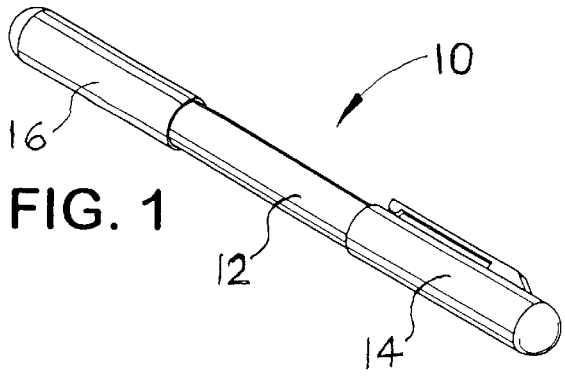
FIG. 1 is a perspective view of a preferred embodiment of the trailer electrical connector cleaning system of the present invention.
Figure 2:
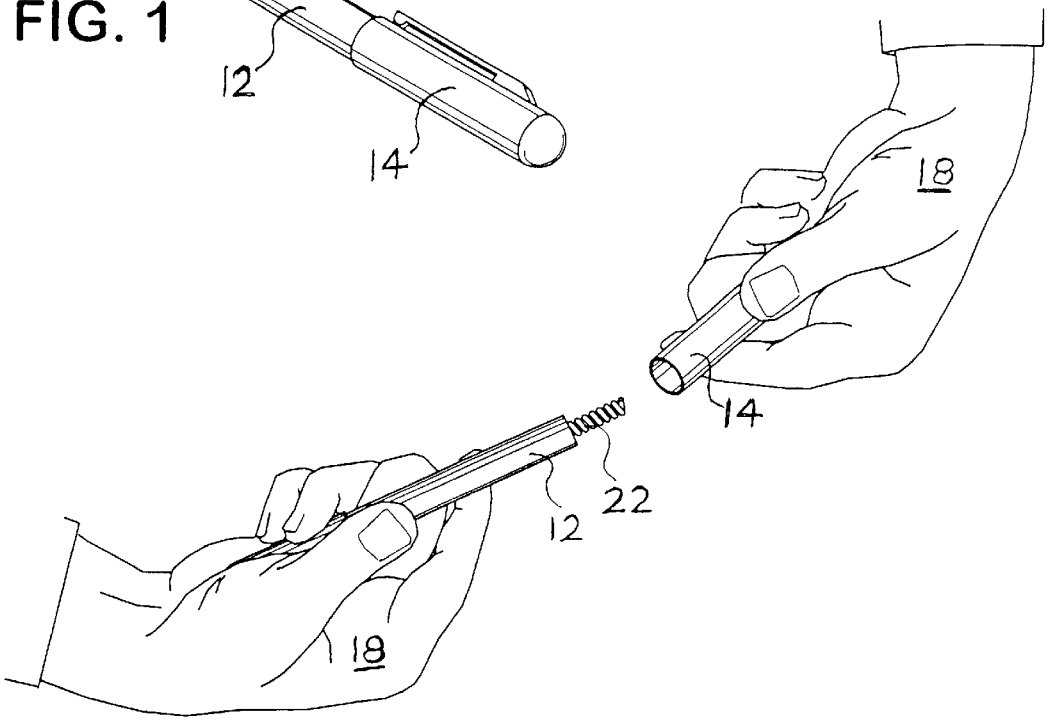
FIG. 2 is a perspective view of a preferred embodiment of the trailer electrical connector cleaning system of the present invention depicting a user removing the protective cap from the male end of the terminal-cleaning element body.

Referring to FIG. 1, a perspective view of a preferred embodiment of the trailer electrical connector cleaning system 10 (the "system 10" hereinafter) of the present invention is shown. The system 10 preferably comprises a terminal-cleaning element body 12, a pocket clip protective cap 14, and a protective cap 16. Such a system 10 embodies herein at least one cleaning structure arranged to enable an axial linear and axial rotational cleaning motion to be applied to a trailer-electrical-connector electrical terminal. Referring to FIG. 2, another perspective view of a preferred embodiment of the system 10 of the present invention is shown depicting a user 18 removing the protective cap 14 from over the male terminal-cleaning element 22 of the terminal-cleaning element body 12. The protective cap 14 is preferably a friction, or snap-fit cap that slides over the male terminal-cleaning element 22 of the terminal-cleaning element body 12. As shown, the system 10 is very small, compact, and adapted to be easily carried in a shirt pocket.

Figure 3:
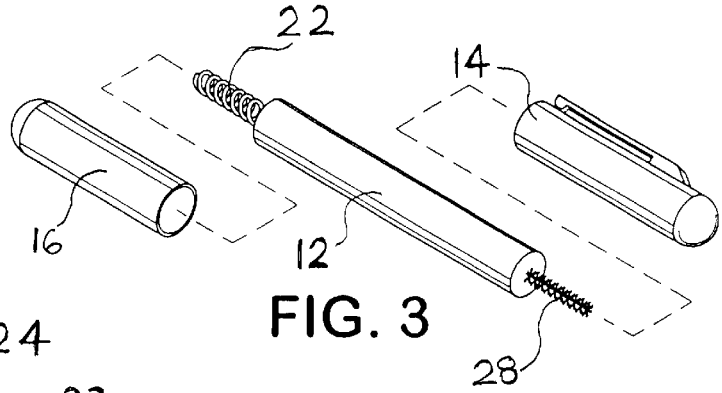
FIG. 3 is a perspective view of a preferred embodiment of the trailer electrical connector cleaning system of the present invention showing both protective caps removed from both ends of the terminal-cleaning element body.

Referring to FIG. 3, a perspective view of a preferred embodiment of the system 10 of the present invention showing both the protective cap 16 and the pocket clip protective cap 14, removed from each end of the terminal-cleaning element body 12 is shown. Although it is shown that the pocket clip protective cap 14 is slid over the female terminal-cleaning element 28, and the protective cap 16 is slid over the male terminal-cleaning element 22, both protective caps 14 and 16 are preferably interchangeable, and may be placed over either the male or the female terminal-cleaning elements 22 and 28. With both of the protective caps 14 and 16 in place, as shown in FIG. 1, coupled to the terminal-cleaning element body 12, the male and female terminal-cleaning elements 22 and 28 are completely enclosed. Such an enclosed, or sealed, carrying position thus provides a feature of substantially isolating the male and female terminal-cleaning elements 22 and 28 from the environment external to the enclosing structure. Such an arrangement is embodied by the at least one enclosing structure arranged to enable enclosing such at least one cleaning structure in such manner as to substantially isolate such at least one cleaning structure from an environment outside such at least one enclosing structure. Thus, the system 10 preferably features a closed, or sealed, carrying position that will not drop debris clinging to the male or the female terminal-cleaning elements 22 and 28 into the pockets of the user's clothing, thus, preventing soiling thereof.

Figure 8:
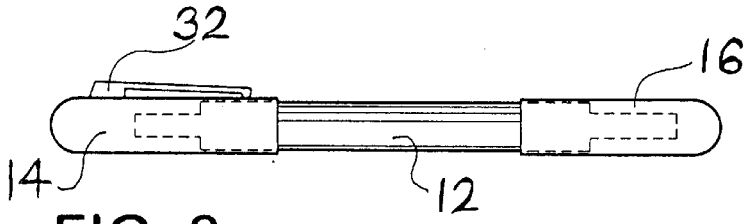
FIG. 8 is an elevational view from one side of a preferred embodiment of the trailer electrical connector cleaning system of the present invention.

Referring to FIG. 8, an elevational view from one side of a preferred embodiment of the system 10 of the present invention is shown. As shown, the pocket clip protective cap 14 preferably comprises a pocket clip 32. The pocket clip 32 may be integral to the body of the pocket clip protective cap 14, or alternatively, may be affixed in an other manner, as is known by those skilled in the art. Such pocket clip 32 and pocket clip protective cap 14 embody herein a pocket clip coupled to such at least one enclosing structure arranged to couple such at least one enclosing structure to a pocket. It should be noted, as previously discussed, that the male and female terminal-cleaning elements 22 and 28 are completely enclosed within the space defined by the protective caps 14 and 16 coupled to either end of the terminal-cleaning element body 12. Such a system 10 embodies herein at least one enclosing structure comprising two substantially-tubular members; and frictional coupling of such at least one cleaning structure and such at least one second cleaning structure to such two substantially-tubular members enables enclosing such at least one cleaning structure and such at least one second cleaning structure in such manner as to substantially isolate such cleaning structures from an environment outside such at least one enclosing structure.

Figure 9:
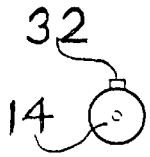
FIG. 9 is an elevational view from one end of a preferred embodiment of the trailer electrical connector cleaning system of the present invention.

Referring to FIG. 9, an elevational view from one end of the system 10 is shown. It should be noted, in reference to FIGS. 8 and 9, that the system 10 has a feature of being a very small compact device adapted to be easily carried in a shirt pocket.

Figure 10:
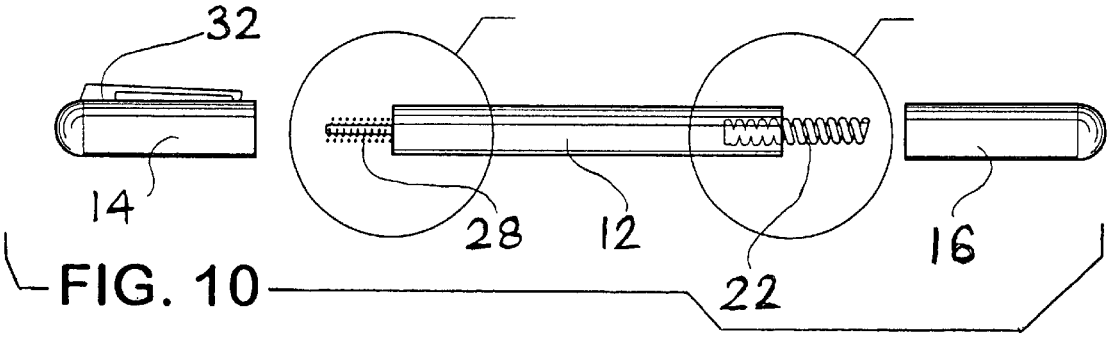
FIG. 10 is an elevational view from one side of a preferred embodiment of the trailer electrical connector cleaning system of the present invention showing both protective caps removed from both ends of the terminal-cleaning element body.

Referring to FIG. 10, an elevational view from one side of a preferred embodiment of the system 10 with both protective caps 14 and 16 removed from both ends of the terminal-cleaning element body 12 is shown.

Figure 11:
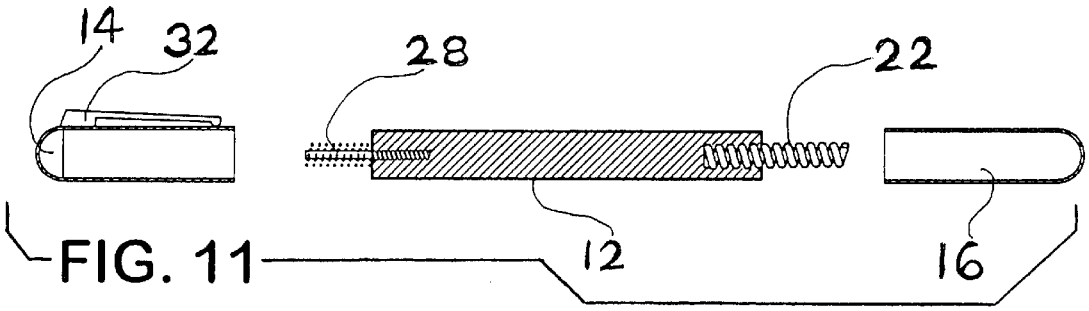
FIG. 11 is an elevational sectional view from one side of a preferred embodiment of the trailer electrical connector cleaning system of the present invention showing both protective caps removed from both ends of the terminal-cleaning element body and both elements exposed.

Referring to FIG. 11, an elevational sectional view from one side of a preferred embodiment of the system 10 showing both protective caps 14 and 16 removed from both ends of the terminal-cleaning element body 12 is shown. Also shown is the male terminal-cleaning element 22 and the female terminal-cleaning element 28, each having about one-half to one-third of their length embedded into the material of the terminal-cleaning element body 12. Such a system 10 embodies herein at least one cleaning structure arranged to enable an axial linear and axial rotational cleaning motion to be applied to a trailer-electrical-connector electrical terminal. Furthermore, such a system 10 embodies at least one second cleaning structure, having an opposite mating structure than the cleaning structure, arranged to enable an axial linear and axial rotational cleaning motion to be applied to a second electrical terminal, wherein the at least one second cleaning structure comprises a brush cleaning element structured and arranged to enable cleaning of female electrical terminals.

Figure 12:
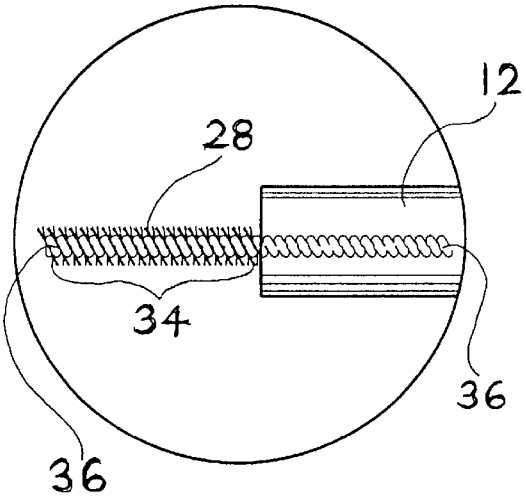
FIG. 12 is a close-up view of a preferred embodiment of the trailer electrical connector cleaning system of FIG. 10 showing the female terminal-cleaning element.

Referring to FIG. 12, a close-up view of the female terminal-cleaning element 28 of the system 10 of FIG. 10 is shown. The female terminal-cleaning element 28 is a brush, or cleaning element, that preferably comprises a double helical wire 36, preferably comprising a bristle material 34 tightly bound into the double helical wire 36. The bristle material 34 is preferably a metal-type material, due to its strength properties. The construction of such double helical wire 36 and bristle material 34 is known to those skilled in the art, although those skilled in the art will recognize that under appropriate circumstances, the female terminal-cleaning element 28 might comprise other types of brushes or cleaning elements.

Figure 13:
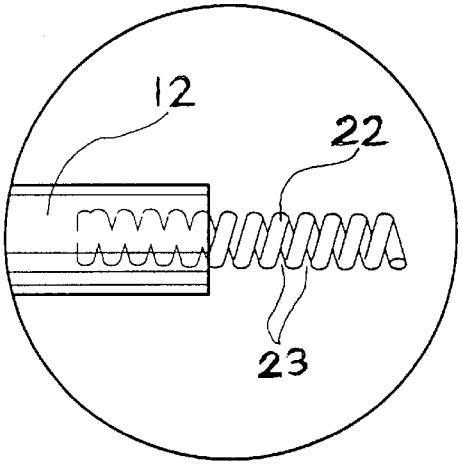
FIG. 13 is a close-up view of a preferred embodiment of the trailer electrical connector cleaning system of FIG. 10 showing the male terminal-cleaning element.

Referring to FIG. 13, a close-up view of the male terminal-cleaning element 22 of the system 10 of FIG. 10 is shown. The male terminal-cleaning element 22 preferably comprises a helical resilient material coil having about one-half to one-third of its length embedded into the material of the terminal-cleaning element body 12. The male terminal-cleaning element 22 will expand to fit different sized male terminals 24, thus providing a feature of enabling the cleaning of different sizes of male terminals 24. Such male terminals 24 comprise substantially hard-metal carrying relatively low-amperage current. For example, the battery posts and clamps of a typical automobile engine comprise lead and carry high starting current, e.g., 100 amps. Such battery posts and clamps are not considered to be within the scope of terminals, male or female, suitable for cleaning by preferred embodiments of the present invention. Furthermore, such a male terminal-cleaning element 22 is preferably comprised of spring steel, and is further preferably stainless steel. Additionally, such a male terminal-cleaning element 22 might further preferably be sandblasted, or otherwise treated as those skilled in the art would utilize in appropriate circumstances, to impart a more abrasive texture to its surface. However, those skilled in the art will recognize that in appropriate circumstances, a material other than spring steel might be used for the composition of a male terminal-cleaning element 22. Further, male terminal-cleaning element 22 will preferably comprise right, or otherwise acute, angled edges 23 upon each inner edge of the spring steel helical resilient material coil. Such an angled edge feature will thus facilitate the cleaning action of the male terminal-cleaning element 22 as it is pushed or screwed onto and off of a male electrical element 24.

Figure 4:
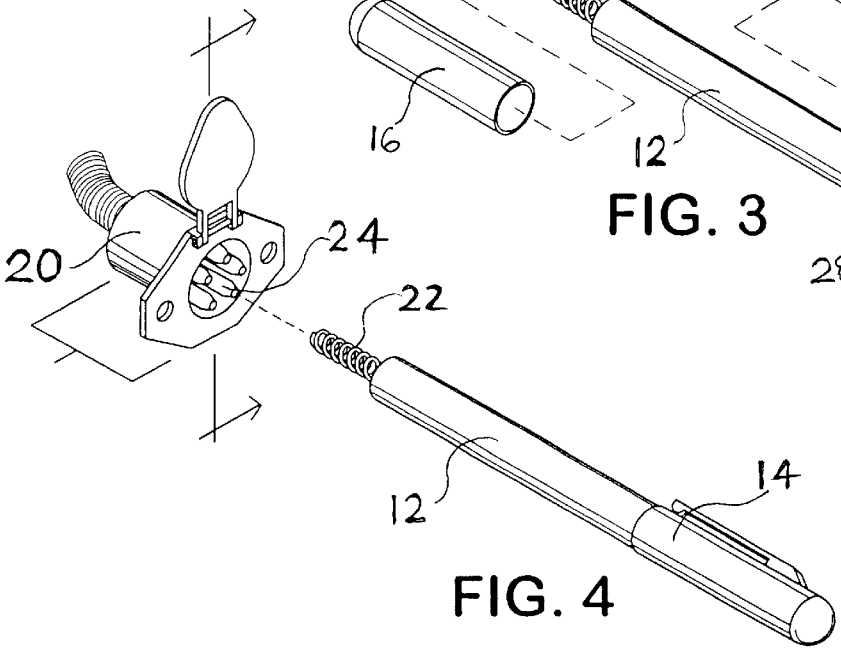
FIG. 4 is a perspective view of a preferred embodiment of the trailer electrical connector cleaning system of the present invention showing the protective cap removed from the male end of the terminal-cleaning element body and the male terminal-cleaning element aligned for placement over a male terminal integral to a trailer electrical jack.

Referring to FIG. 4, a perspective view of a preferred embodiment of the system 10 with the protective cap 16 removed from the male end of the terminal-cleaning element body 12 and the male terminal-cleaning element 22 aligned for insertion over one of the male terminals 24 integral to a trailer electrical jack 20 is shown. It should be noted that although a particular trailer electrical jack 20 is shown, this jack is representative of many different types and styles of trailer electrical jacks having different arrangements and configurations of electrical terminals. Those skilled in the art will recognize that embodiments of the present invention are therefore not only usable with such different arrangements and configurations of electrical terminals, but are, in fact, particularly well-suited to be usable with many such arrangements and configurations of electrical terminals due to the feature of having single resilient cleaning elements.

Figure 6:
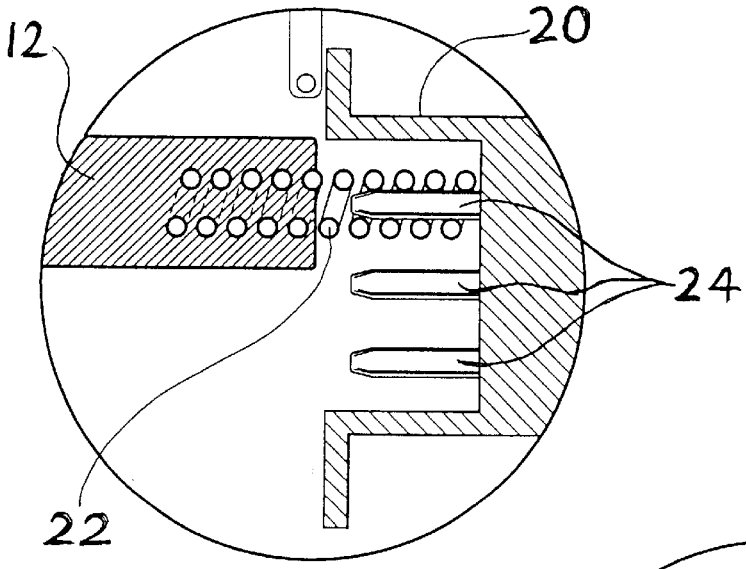
FIG. 6 is a close-up sectional view of a preferred embodiment of the trailer electrical connector cleaning system of FIG. 4 showing the male terminal-cleaning element placed over a male terminal integral to a trailer electrical jack.

Referring to FIG. 6, a close-up sectional view of the system 10 of FIG. 4 shows the male terminal-cleaning element 22 inserted over a male terminal 24 integral to a trailer electrical jack 20. It will be noted, as would be recognized by those skilled in the art, that the male terminal-cleaning element 22 has one end preferably embedded into the material of the terminal-cleaning element body 12. The other exposed end of the male terminal-cleaning element 22 is inserted over a male terminal 24. The male terminal-cleaning element 22 is preferably comprised of a helical resilient material coil. Such a spiral coil will result in the male terminal-cleaning element 22 expanding slightly as it is pushed and/or rotated onto and off of a male terminal 24. The result of pushing the helical resilient material coil of the male terminal-cleaning element 22 onto a male terminal 24 is a combination of both linear axial and rotational axial cleaning movements. Thus, a male terminal 24 that has had a male terminal-cleaning element 22 pushed and/or rotated onto and off of it has had a planar cleaning action substantially performed upon each point of the surface of the male terminal 24. Additionally, such a helical resilient material coil comprising a male terminal-cleaning element 22 will expand to fit different sized male terminals 24, thus, providing a feature of enabling cleaning of different sizes of male terminals 24. Such a male terminal-cleaning element 22 is preferably comprised of spring steel, and is further preferably stainless steel. Additionally, such a male terminal-cleaning element 22 might further preferably be sandblasted, or otherwise treated as those skilled in the art would utilize in appropriate circumstances, to impart a more abrasive texture to its surface. Those skilled in the art will recognize that in appropriate circumstances, a material other than spring steel might be used for the composition of a male terminal-cleaning element 22. Additionally, those skilled in the art will appreciate that embodiments of the present invention preferably comprise a single cleaning element. Thus, where such single cleaning element is metal, short-circuiting between the electrical terminals of a trailer electrical plug will not occur, thus, preventing damage to electrical systems or the necessity to de-energize such electrical systems.

Figure 5:
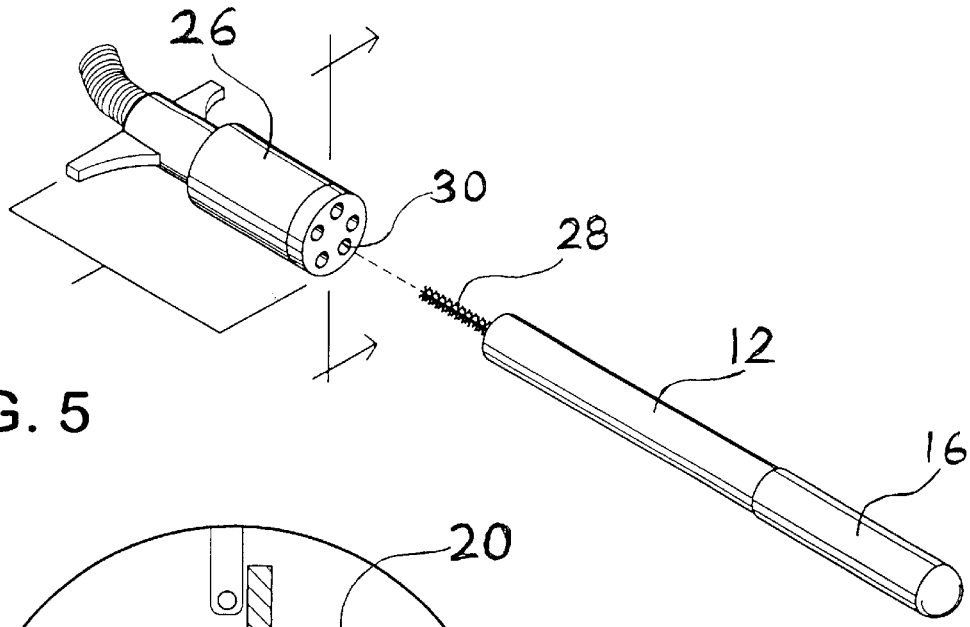
FIG. 5 is a perspective view of a preferred embodiment of the trailer electrical connector cleaning system of the present invention showing the pocket clip protective cap removed from the female end of the terminal-cleaning element body and the female terminal-cleaning element aligned for insertion into a female terminal integral to a trailer electrical plug.

Referring to FIG. 5, a perspective view of a preferred embodiment of the system 10 showing the pocket clip protective cap 14 removed from the female end of the terminal-cleaning element body 12 is shown. Additionally, the female terminal-cleaning element 28 is shown aligned for insertion into a female terminal 30 integral to a trailer electrical plug 26. It should be noted that although a particular trailer electrical plug 26 is shown, this plug is representative of many different types and styles of trailer electrical plugs having different arrangements and configurations of electrical terminals. Those skilled in the art will recognize that embodiments of the present invention are therefore not only usable with such different arrangements and configurations of electrical terminals as described, but are, in fact, particularly well-suited to be usable with many such arrangements and configurations of electrical terminals upon many different electrical plugs, due to the feature of having a single resilient cleaning element.

Figure 7:
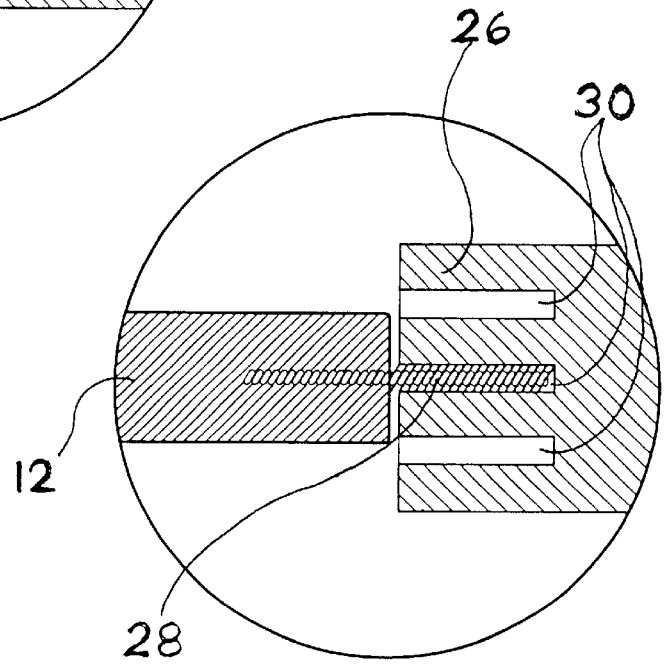
FIG. 7 is a close-up sectional view of a preferred embodiment of the trailer electrical connector cleaning system of FIG. 5 showing the female terminal-cleaning element inserted into a female terminal integral to a trailer electrical plug.

Referring to FIG. 7, a close-up sectional view of the system 10 of FIG. 5 shows the female terminal-cleaning element 28 inserted into a female terminal 30 integral to a trailer electrical plug 26. It will be noted, as known by those skilled in the art, that the female terminal-cleaning element 28 has one end preferably embedded into the material of the terminal-cleaning element body 12. The other exposed end of the female terminal-cleaning element 28 is inserted into a female terminal 30.

With reference to FIG. 12, the female terminal-cleaning element 28 is preferably a brush, or cleaning element, that preferably comprises a double helical wire 36, preferably comprising a bristle material 34 tightly bound into the double helical wire 36. The bristle material 34 is preferably a metal-type material, due to its strength properties. Additionally, the bristle material 34 is further preferably comprised of stainless steel, although those skilled in the art will recognize that in appropriate circumstances, a material other than stainless steel might be used for the composition of the bristle material 34. The double helical wire 36 is preferably comprised of spring steel, and is further preferably comprised of stainless steel. Those skilled in the art will recognize that in appropriate circumstances, a material other than spring steel might be used for the composition of the double helical wire 36. Additionally, those skilled in the art will appreciate that embodiments of the present invention preferably comprise a single cleaning element. Therefore, where such single cleaning element is metal, short-circuiting between the electrical terminals of a trailer electrical plug will not occur, thus, preventing damage to electrical systems or the necessity to de-energize such electrical systems. Although a preferred design and construction of the female terminal-cleaning element 28 has been described herein, those skilled in the art will recognize that under appropriate circumstances, the female terminal-cleaning element 28 might comprise other types of brushes or cleaning elements.

Referring again to FIGS. 5 and 7, the female terminal-cleaning element 28 is inserted into a female terminal 30, and then retracted from the female terminal 30. Such linear axial cleaning motion may be further preferably accompanied with an axial rotational twisting action of the female terminal-cleaning element 28 within the female terminal 30. The combination of both linear axial and rotational axial cleaning movements results in substantially every portion of the surface of a female terminal coming into contact with the bristle material 34, thus achieving the greatest possible degree of cleaning of the female terminal 30. Thus, a female terminal 30 that has had a female terminal-cleaning element 28 pushed and/or rotated into and out of it has had a planar cleaning action substantially performed upon each point of the surface within the female terminal 30. Additionally, such a double helical wire 36 and bristle material 34 preferably comprises resilient properties that enable a female terminal-cleaning element 28 to expand or compress to fit into different sized female terminals 30, thus, providing a feature of enabling cleaning of different sizes of female terminals 30. Such female terminals 30 comprise substantially hard-metal carrying relatively low-amperage current. For example, the battery posts and clamps of a typical automobile engine comprise lead and carry high starting current, e.g., 100 amps. Such battery posts and clamps are not considered to be within the scope of terminals, male or female, suitable for cleaning by preferred embodiments of the present invention.

Figure 14:
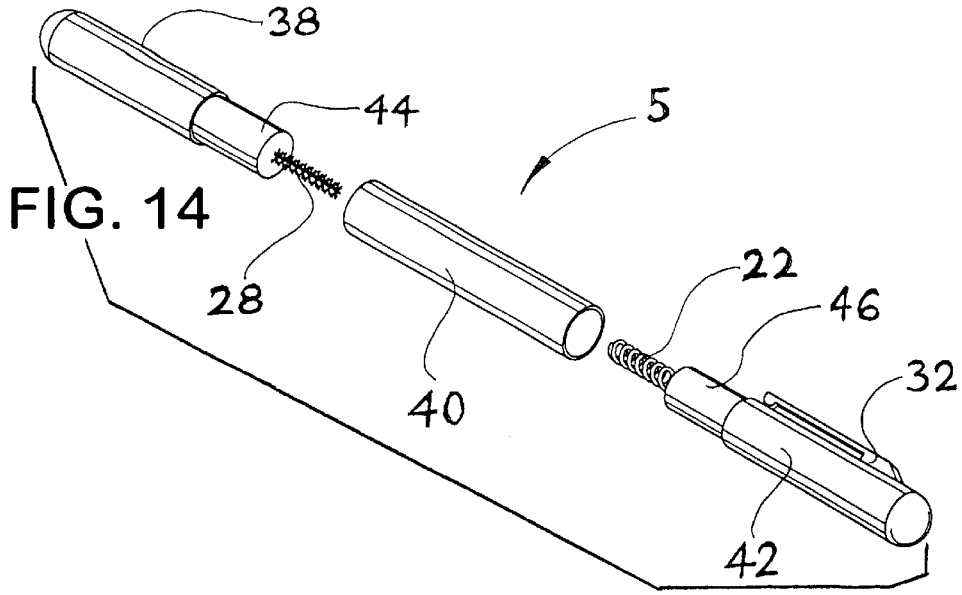
FIG. 14 is a perspective view of an alternative preferred embodiment of the trailer electrical connector cleaning system of the present invention showing both terminal-cleaning element holders removed from the cleaning element protective body.

Referring to FIG. 14, a perspective view of an alternative preferred embodiment of the trailer electrical connector cleaning system (the "system 5" hereinafter) of the present invention having two alternative terminal-cleaning element holders 38 and 42 removed from the cleaning element protective body 40 is shown. The system 5 preferably comprises a cleaning element protective body 40 that is preferably an open tube, although in appropriate circumstances, a sealing divider might be positioned approximately in the middle of the open tube, thus sealing one end of the cleaning element protective body 40 from the opposite end. Into each end of the cleaning element protective body 40 is slid, interchangeably, either a female terminal-cleaning element holder 38, or a male terminal-cleaning element holder 42. The female terminal-cleaning element holder 38 preferably comprises a reduced-diameter female terminal-cleaning element holder neck 44 sized to frictionally slide within either end of the cleaning element protective body 40. Embedded within the end of the female terminal-cleaning element holder neck 44 is the female terminal-cleaning element 28 previously described. The male terminal-cleaning element holder 42 preferably comprises a reduced-diameter male terminal-cleaning element holder neck 46 sized to frictionally slide within either end of the cleaning element protective body 40. Embedded within the end of the male terminal-cleaning element holder neck 46 is the male terminal-cleaning element 22 previously described. Such a system 5 embodies herein an enclosing member, wherein such at least one enclosing structure comprises a single substantially-tubular member; and wherein such at least one cleaning structure is substantially completely enclosed and substantially completely isolated from an environment outside such at least one enclosing structure by the insertion and frictional coupling of such at least one cleaning structure to such enclosing member.

The male terminal-cleaning element holder 42 further preferably comprises a pocket clip 32. The pocket clip 32 may be integral to the body of the male terminal-cleaning element holder 42, or alternatively, may be affixed in another manner, as is known by those skilled in the art. Additionally, those skilled in the art will recognize that it may be preferable, in some situations, to affix the pocket clip 32 to the female terminal-cleaning element holder 38. The female terminal-cleaning element holder 38 preferably comprises a reduced-diameter female terminal-cleaning element holder neck 44 sized to frictionally slide within either end of the cleaning element protective body 40.

With both the female terminal-cleaning element holder 38 and the male terminal-cleaning element holder 42 in place, frictionally coupled to the cleaning element protective body 40, the female terminal-cleaning element 28 and the male terminal-cleaning element 22 are completely enclosed. Thus, the system 5 preferably features a closed, or sealed, carrying position that will not drop debris clinging to the female terminal-cleaning element holder 38, or the male terminal-cleaning element holder 42 into the pockets of a user's clothing. Additionally, it should be noted that the system 5 has a feature of being a very small compact device adapted to be easily carried in a shirt pocket.

Figure 15:
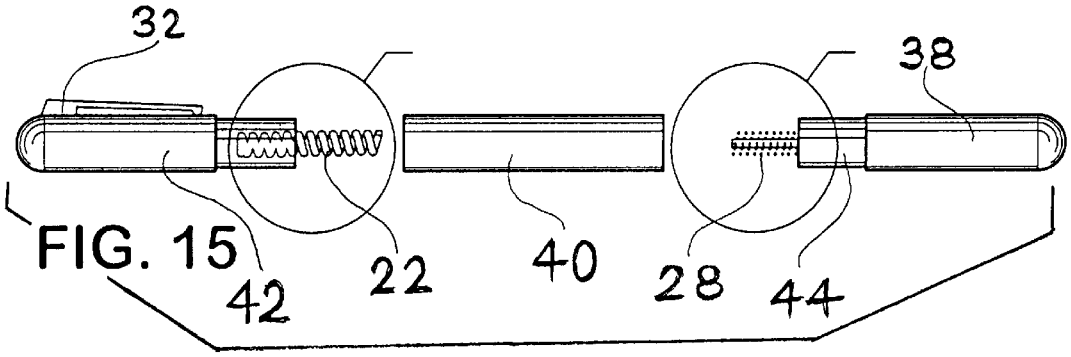
FIG. 15 is an elevational view from one side of an alternative preferred embodiment of the trailer electrical connector cleaning system of the present invention showing both terminal-cleaning element holders removed from the cleaning element protective body.

Referring to FIG. 15, an elevational view from one side of an alternate preferred embodiment of the system 5 with both the female terminal-cleaning element holder 38, and the male terminal-cleaning element holder 42 removed from both ends of the cleaning element protective body 40 is shown.

Figure 16:
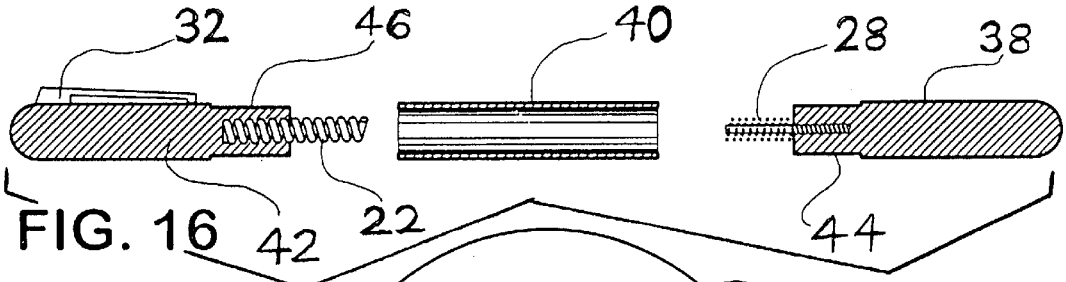
FIG. 16 is an elevational sectional view from one side of an alternative preferred embodiment of the trailer electrical connector cleaning system of the present invention showing both terminal-cleaning element holders removed from the cleaning element protective body.

Referring to FIG. 16, an elevational sectional view from one side of a preferred embodiment of the system 5 illustrating both the female terminal-cleaning element holder 38, and the male terminal-cleaning element holder 42 removed from both ends of the cleaning element protective body 40 is shown. Also shown is the male terminal-cleaning element holder 42 and the female terminal-cleaning element holder 38, each having about one-half to one-third of their length embedded into the material of their respective male terminal-cleaning element holder neck 46 and female terminal-cleaning element holder neck 44.

With reference to FIGS. 12 and 13, a preferred design and construction of the female terminal-cleaning element 28 and the male terminal-cleaning element 22 remains substantially as previously described. However, rather than into the material of the terminal-cleaning element body 12, the ends of the female terminal-cleaning element 28 and the male terminal-cleaning element 22 each have about one-half to one-third of their length embedded into the material of their respective male terminal-cleaning element holder neck 46 and female terminal-cleaning element holder neck 44.

Figure 17:
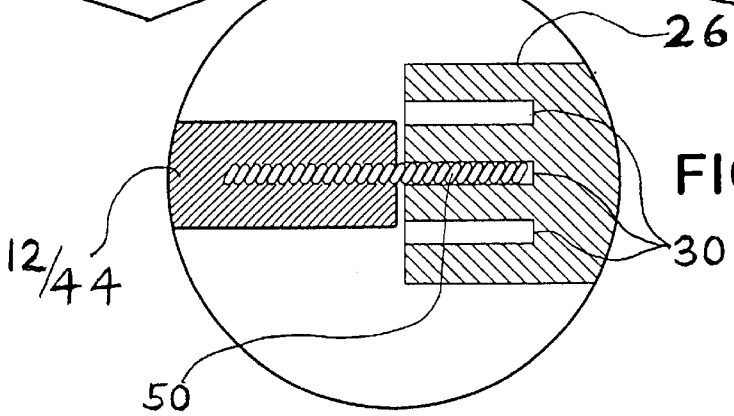
FIG. 17 is a close-up sectional view of another preferred embodiment of a trailer electrical connector cleaning system showing an alternate female terminal-cleaning element inserted into a female terminal integral to a trailer electrical plug.

Referring to FIG. 17, a close-up sectional view of an alternate female terminal-cleaning element 50 inserted into a female terminal 30 integral to a trailer electrical plug 26, as may be utilized in either system 5, or system 10, is shown. In such a manner, as previously described, the alternate female terminal-cleaning element 50 has one end preferably embedded into either the material of the terminal-cleaning element body 12, or into the material of the female terminal-cleaning element holder neck 44. The other exposed end of the alternate female terminal-cleaning element 50 is inserted into a female terminal 30. The alternate female terminal-cleaning element 50 is preferably comprised of spring steel, and is further preferably stainless steel. Additionally, such an alternate female terminal-cleaning element 50 might further preferably be sandblasted, or otherwise treated as those skilled in the art would utilize in appropriate circumstances, to impart a more abrasive texture to its surface. Those skilled in the art will recognize that in appropriate circumstances, a material other than spring steel might be used for the composition of an alternate female terminal-cleaning element 50. Furthermore, an alternate female terminal-cleaning element 50 will preferably comprise right, or otherwise acute, angled edges upon each outer edge of the spring steel helical resilient material coil. Such feature will thus facilitate the cleaning action of the alternate female terminal-cleaning element 50 as it is pushed or rotated into and out of a female terminal 30. Those skilled in the art will recognize that in appropriate circumstances, a material other than spring steel might be used for the composition of the alternate female terminal-cleaning element 50.

Further, many other advantages of applicant's invention will be apparent to those skilled in the art from the above descriptions and the below claims.

What is claimed is:

1. A trailer-electrical-connector cleaning system, for cleaning male electrical terminals and female electrical terminals, comprising, in combination:

a) at least one first cleaning structure arranged to enable an axial linear and axial rotational cleaning motion to be applied to at least one trailer-electrical-connector electrical terminal; and b) at least one second cleaning structure, having an opposite mating structure than said at least one first cleaning structure, arranged to enable an axial linear and axial rotational cleaning motion to be applied to a second electrical terminal;

c) wherein said at least one first cleaning structure comprises at least one substantially cylindrical helical cleaning element;

d) wherein said at least one substantially cylindrical helical cleaning element is structured and arranged to permit placement of a male electrical terminal within said at least one substantially cylindrical helical cleaning element;

e) wherein said at least one first cleaning structure comprises a spring.

2. The system of claim 1 further comprising at least one enclosing structure arranged to enable enclosing said at least one first cleaning structure in such manner as to substantially isolate said at least one first cleaning structure from an environment outside said at least one enclosing structure.

3. The system of claim 2 further comprising a pocket clip, coupled to said at least one enclosing structure, arranged to couple said at least one enclosing structure to a pocket.

4. The system of claim 2 wherein:

a) said at least one enclosing structure comprises a single substantially-tubular member; and b) frictional coupling of said at least one cleaning structure and said at least one second cleaning structure to said single substantially-tubular member enables enclosing said at least one cleaning structure and said at least one second cleaning structure in such manner as to substantially isolate said cleaning structures from an environment outside said at least one enclosing structure.

5. The system of claim 2 wherein:

a) said at least one enclosing structure comprises two substantially-tubular members; and b) frictional coupling of said at least one cleaning structure and said at least one second cleaning structure to said two substantially-tubular members enables enclosing said at least one cleaning structure and said at least one second cleaning structure in such manner as to substantially isolate said cleaning structures from an environment outside said at least one enclosing structure.

6. The system of claim 1 wherein said at least one second cleaning structure comprises a brush cleaning element structured and arranged to enable cleaning of female electrical terminals.

7. The system of claim 6 wherein said brush cleaning element comprises bristle material comprised of steel.

8. The system of claim 7 wherein said steel comprises stainless steel.

9. The system of claim 1 wherein said helical cleaning element comprises steel.

10. The system of claim 9 wherein said steel comprises stainless steel.

11. The system of claim 9 wherein said helical cleaning element comprises an abrasive surface.

12. The system of claim 1 wherein said spring comprises steel.

13. The system of claim 12 wherein said steel comprises stainless steel.

14. The system of claim 13 wherein said spring comprises an abrasive surface.

15. An electrical connector cleaning system for cleaning electrical terminals of hard-metal, low-amperage vehicle electrical connectors comprising, in combination:

a) at least one cleaning structure arranged to enable an axial linear and axial rotational cleaning motion to be applied to an electrical terminal; and b) at least one second cleaning structure, having an opposite mating structure than said at least one cleaning structure, arranged to enable an axial linear and axial rotational cleaning motion to be applied to a second electrical terminal;

c) wherein said at least one first cleaning structure comprises at least one substantially cylindrical helical cleaning element;

d) wherein said at least one substantially cylindrical helical cleaning element is structured and arranged to permit placement of a male electrical terminal within said at least one substantially cylindrical helical cleaning element;

e) wherein said at least one first cleaning structure comprises a spring.

16. The system of claim 15 wherein said at least one second cleaning structure comprises a brush cleaning element structured and arranged to enable cleaning of female electrical terminals.

17. The system of claim 16 wherein said brush cleaning element comprises bristle material comprised of steel.

18. The system of claim 17 wherein said steel comprises stainless steel.

19. The system of claim 15 wherein said helical cleaning element comprises steel.

20. The system of claim 19 wherein said steel comprises stainless steel.

21. The system of claim 19 wherein said helical cleaning element comprises an abrasive surface.

22. The system of claim 15 wherein said at least one second cleaning structure comprises a helical cleaning element structured and arranged to enable cleaning of female electrical terminals.

23. The system of claim 22 wherein said helical cleaning element comprises steel.

24. The system of claim 23 wherein said steel comprises stainless steel.

25. The system of claim 23 wherein said helical cleaning element comprises an abrasive surface.

26. An electrical connector cleaning system for non-lead, low-amperage, electrical terminals, comprising, in combination:

a) at least one first cleaning structure arranged to enable an axial linear and axial rotational cleaning motion to be applied to the electrical terminals; and b) wherein said at least one first cleaning structure comprises a substantially cylindrical helical cleaning element structured and arranged to clean the electrical terminals;

c) at least one second cleaning structure, having an opposite mating structure than said at least one first cleaning structure, arranged to enable an axial linear and axial rotational cleaning motion to be applied to a second electrical terminal;

d) wherein said at least one first cleaning structure comprises at least one substantially cylindrical helical cleaning element;

e) wherein said at least one substantially cylindrical helical cleaning element is structured and arranged to permit placement of a male electrical terminal within said at least one substantially cylindrical helical cleaning element;

f) wherein said at least one first cleaning structure comprises a spring.

27. The system of claim 26 wherein said helical cleaning element comprises steel.

28. The system of claim 27 wherein said steel comprises stainless steel.

29. The system of claim 27 wherein said steel comprises an abrasive surface.

30. The system of claim 26 further comprising at least one enclosing structure, wherein:

a) said at least one enclosing structure comprises a single substantially-tubular member; and b) frictional coupling of said at least one cleaning structure to said single substantially-tubular member enables enclosing said at least one cleaning structure in such manner as to substantially isolate said cleaning structure from an environment outside said at least one enclosing structure.

31. The system of claim 30 further comprising a pocket clip coupled to said at least one enclosing structure arranged to couple said at least one enclosing structure to a pocket.

32. The system of claim 26 wherein said helical cleaning element comprises a sharp edge upon inner circumferential edges of said helical cleaning element structured and arranged to assist cleaning of electrical terminals of male design.

33. The system of claim 26 wherein said at least one second cleaning structure comprises at least one second helical cleaning element which comprises a sharp edge upon outer circumferential edges of said second helical cleaning element structured and arranged to assist cleaning of electrical terminals of female design.

* * * * *